US005960779A

United States Patent [19]

Jessee et al.

[11] Patent Number: 5,960,779

[45] **Date of Patent: *Oct. 5, 1999**

[54] ARROW REST AND LAUNCHER

[75] Inventors: Edward M. Jessee, Louisville; B. Howard Coffey, LaGrange, both of Ky.

[73] Assignee: Coffey Marketing Corporation, Crestwood, Ky.

[ * ] Notice: This patent is subject to a terminal disclaimer.

[21] Appl. No.: 08/594,601

[22] Filed: Jan. 31, 1996

Related U.S. Application Data

[63] Continuation-in-part of application No. 08/323,868, Oct. 17, 1994.

[51] Int. Cl.[6] ..... F41B 5/22

[52] U.S. Cl. ..... 124/44.5

[58] Field of Search ..... 124/24.1, 25.6, 124/44.5, 86, 88

[56] References Cited

U.S. PATENT DOCUMENTS

| | | | |
|---|---|---|---|
| 3,890,951 | 6/1975 | Jennings et al. | 124/44.5 |
| 4,074,674 | 2/1978 | Simo | 124/44.5 |
| 4,662,346 | 5/1987 | Laffin | 124/44.5 |
| 4,899,716 | 2/1990 | Martin et al. | 124/44.5 |
| 5,144,937 | 9/1992 | Colvin | 124/44.5 |
| 5,181,502 | 1/1993 | Ray | 124/44.5 |
| 5,213,090 | 5/1993 | Tone | 124/44.5 |
| 5,251,606 | 10/1993 | Colvin | 124/44.5 |
| 5,353,778 | 10/1994 | Blankenship | 124/44.5 |
| 5,372,119 | 12/1994 | Kidney | 124/44.5 |
| 5,429,107 | 7/1995 | Troncoso | 124/44.5 |
| 5,526,799 | 6/1996 | Simo | 124/44.5 |
| 5,743,245 | 4/1998 | Mizek | 124/44.5 |

*Primary Examiner*—John A. Ricci

*Attorney, Agent, or Firm*—David W. Carrithers; Carrithers Law Office

[57] ABSTRACT

An arrow rest arrangement for an archery bow and a quick change launcher formed from a friction reducing noise arresting polymer composition in selected sizes and shapes to facilitate different types of arrows. The launcher supports the arrow prior to launching and provides initial guidance to the arrow at launch. The arrow rest includes a holder for retaining the arrow in position prior to shooting.

13 Claims, 8 Drawing Sheets

ARROW REST AND LAUNCHER

This application is a Continuation-In-Part of U.S. patent application Ser. No. 08/323,868 filed on Oct. 17, 1994.

BACKGROUND OF THE INVENTION

This invention relates to archery and more particularly to devices useful as arrow rests and arrow launchers used with bows, particularly compound bows, as arrow support and guide devices.

Various archery arrow rests, have been devised for attachment to an archery bow to permit shooting an arrow therefrom with proper clearance of the bow. Arrow rests are typically used in both sport and hunting activities utilizing bows to stabilize the arrow before and during launching from the bow. In general, arrow rests are located on a lateral extension of the mid portion of the bow to facilitate accurate aim. Conventional devices consist of numerous designs for arrow rests. Each includes an arrow launcher, and possesses adjustment arrangements where the arrow launcher may be adjusted for its vertical position and its horizontal position relative to the bow.

Conventional arrow rests are taught by U.S. Pat. No. 5,137,006 which provides a pair of spaced elongate supports to support the arrow therebetween. The supports are flexible to allow selected depression of the arrow on the rest by adjustment of the angle of attack of the supports. Another rest configuration is disclosed in U.S. Pat. No. 3,935,854 which teaches an arrow rest with vertical depression which is asserted to improve accuracy by dampening vertical oscillation of the arrow launching off of the arrow rest. U.S. Pat. No. 5,107,818 teaches an arrangement which is easily laterally adjusted and includes a support member which pivots in response to the arrow vanes passing over it to maintain stability.

In an effort to increase arrow speed and increase the defective target size by flattening out the arrow trajectory, archery arrow manufacturers have began to produce arrows with narrow shaft diameters and high tensile strength. This has been accomplished through the use of resin-impregnated graphite and carbon cloth wound by-directionally around a mandrel and heated to above the set point of the resin to form a hollow arrow shaft which is light in weight, strong and of small diameter. The state of the art shafts are reinforced by very thin-walled hollow, high tensile strength aluminum cores to increase their consistency of spin, weight, and straightness and to prevent their shattering, which can occur with either solid core or hollow unreinforced carbon and graphite arrows. Heretofore, reference to carbon arrows is meant to include both carbon and graphite arrows and composite arrows also including constituents such as fibers, having hollow or solid cores, unreinforced or thin-walled aluminum tubes.

These graphite cloth and carbon cloth arrow shafts have rough and abrasive exterior surfaces due to the weave characteristics and to the inherent physical characteristics of the carbon and/or graphite fibers from which they are composed. Because arrows made from such material are fired at speeds of up to about 350 feet per second, considerable frictional wear of the rest occurs from contact with the exterior of the shaft creating severe wear on the arrow rest and/or launcher used in combination therewith. The shooting accuracy decreases as the rest wears because the point of aim changes. Thus, arrows aimed from a new rest strike the target in a location different from the location of strike on the target when the rest is worn down by friction. Installation of a new rest or launcher requires that the archer go through a tedious test period of shooting to determine the proper point of aim for different distances from the target. Archers are constantly seeking arrow rests and launchers therefor which remain sturdy and reliable and do not require frequent replacement because the tuning procedure is time consuming and tedious.

Since about 1985, 3-D shooting has become a popular sport. The 3-D shooter prefers to shooting at targets which are in the form of life-like and life-sized animals such as are encountered during hunting. Targets are usually made out of self-healing rubberized foam and are shaped and painted with life-like colors to add realism to the sport of target practice. The targets are usually placed at random distances and sometimes under partial cover to simulate hunting situations. In order for the bowhunter to hit the 3-D target, the bow sight must be accurately calibrated for distances by trial and error and remain accurate. However, accuracy may be compromised if the arrow rest or launcher is worn, which is often the situation when using carbon and/or graphite arrows. Wearing of the prong or forked tip of the conventional arrow rest launcher causes a change in the aiming point and soon renders the arrow rest and/or launcher useless.

Moreover, carbon and graphite arrows are very expensive; therefor, it is desirable to use less expensive arrows having shafts of wood or tempered aluminum for practice. The wood or aluminum shafts have larger diameters than those of the previously described carbon and graphite arrows to compensate for the structural strength of the material of construction. Because it is important for shooting accuracy that the arrow be closely cradled by the arrow rest so that it will not wobble in the rest or slip off of the rest before it is shot, a conventional arrow rest launcher used to cradle a small diameter carbon or graphite arrow may not safely support and guide a larger diameter wood or aluminum arrow. Thus a new rest and or launcher must be installed on the bow to use arrows of various diameters.

The present invention provides an arrow rest and a launcher which may used therewith or with other conventional rests which resists wear from carbon and graphite arrows and can also be used to cradle and secure arrows having shafts of various diameters. The rests are composed of a specially formulated high wear, low friction composition which reduces noise in dry and wet conditions. They do not produce arrow shaft wear to any appreciable degree and are small enough to assure that the vanes of the arrow will not strike it during shooting of the arrow. Moreover, the present invention provides a means for quick replacement or adjustment of the launcher to facilitate different arrow shaft sizes.

The present invention provides a means to hold and steady an arrow suspended on an arrow rest and launcher to improve the speed of draw and accuracy of aim as does the arrow rest and launcher assembly of the present invention. Moreover, the launcher of the present invention is composed of a super slippery, friction reducing compound which does not decrease the speed of the arrow, cause drag on the arrow during launch, or affect the accuracy of the arrow projectile. Furthermore, the launchers of the present invention provide a means of damping the noise associated with the arrow touching the launcher.

It is an object of the present invention to provide an arrow rest for holding and carrying the arrow within the bow at rest.

It is another object of the present invention to provide a holding means to steady the arrow before release.

It is another object of the present invention to provide an arrow rest retaining means which may be used in combination with a variety of arrow rests.

It is another object of the present invention to provide a launcher which is composed of friction reducing material providing optimal arrow speed and accuracy.

It is another object of the present invention to provide a launcher composed of a tough resilient, long wearing material which reduces the noise associated with the arrow touching the launcher.

It is another object of the present invention to provide a launcher which may be used in combination with a variety of arrow rests.

It is yet another object of the present invention to provide an arrow rest having a plurality of different size arrow guide grooves on the same launcher to allow for quick adjustment and change for different types of arrows.

SUMMARY OF THE INVENTION

The present invention relates to arrow rests for bows and more particularly to an effective and efficient arrangement for resting an arrow prior to launch. The present invention defines an arrow rest, arrow rest holding means, and launcher. The arrow rest holding means and launcher may be used interchangeably with various arrow rest which are commercially available such as described in U.S. Pat. No. 5,429,107 by Troncoso, Jr,; U.S. Pat. No. 5,372,119 by Kidney; and U.S. Pat. No. 4,899,716 by Martin et el., all of which are herein incorporated by reference.

Devices within the scope of the present invention eliminate the mechanical apparatus required of prior apparatus and provide more reliable operation than available previous apparatus. Devices within the scope of the present invention utilized launchers formed from blocks of specially formulated low friction material having at least one groove support guide means to position the arrow within the launcher. The groove support guide of the launcher is shaped and sized to support different arrows before and during launch to prevent contact with the vanes of the arrow. Accordingly, devices within the scope of the present invention advantageously allow launch of the arrow with minimal interference and deflection of the arrow during launch.

More particularly, one preferred embodiment of the present invention provides an arrow rest arrangement for an archery bow including a rod rotatably received in the base member attached to the bow where a pin extends outwardly from the rod and holds an arrow launcher formed from low friction polymer sized and shaped to support an arrow prior to launching and to provide initial guidance to the arrow at launch without significant interference thereof. Moreover, the launcher is reversible and adjustable on the bow, in the field or on the range. Furthermore, the specially formulated polymer composition of the launcher arrests the noise associated with surface of the bow contacting the surface of the launcher and/or arrow rest.

The Launcher of the present invention is comprised of mixture of LEXAN®, TEFLON® tetrafluoroethylene and silicon combined under heat and pressure to produce a durable reduced friction and quiet surface which remains in its original configuration despite repeated shooting of carbon arrows therefrom.

The arrow rest includes a conventional mounting block of other means for mounting the arrow rest on the sidewall of the bow opposite the arrow window. The block extends rearwardly of the bow and has a crossbar rotatably secured thereto, as by a spring. The crossbar extends behind the bow handle to an adjustable location behind the arrow window. The launcher arm is releasably connected to the crossbar and extends forwardly and upwardly into the arrow window. The spring permits the launcher arm to pivot downwardly in response to arrow shaft pressure as the arrow is shot from the bow.

The launcher of the first preferred embodiment includes a plurality of arrow support guides, each of which has a downwardly and forwardly extending front launching notch designed to cradle the arrow shaft. The surface of the notches are smooth and each deepens from the upper rear end thereof to the lower front end thereof. The solid launcher composed of the special polymer formulation is hard enough to resist wear from the carbon arrow shaft, yet provide a reduced friction holding means. The launcher is removable and also adjustable while still in the bow in the vertical direction by decreasing or increasing the length of the pin base or by rotating the launcher within the arrow rest holding means to select a particular sized or shaped notch for cooperative engagement with a particular selected arrow.

The launcher of the second preferred embodiment is comprised of the same mixture of LEXAN®, TEFLON® and silicon combined under heat and pressure to produce a durable reduced friction and quiet surface; however, a pair of generally cylindrical launchers having tapered top ends are used in combination to support the arrow thereon.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The arrow rest of the present invention is manufactured from readily available materials and simple in design. The preferred embodiment is comprised of metal and or plastic.

The arrow launcher of the preferred invention is comprises of a mixture of LEXAN®, TEFLON®, and silicon heated under heat and pressure to form a polymer composite which resists abrasion, wear, and heat; reduces friction; reduces the noise associated with a shaft moving thereover in both dry and wet conditions; and permits an increase in the speed of the arrow sliding thereover as compared to conventional arrow rests and arrow rest launch combinations. The arrow rest launch of the preferred embodiment comprises a range of about 10% to about 40% LEXAN®, (General Electric's trademark name for the polymer polycarbonate) about 5% to about 30% TEFLON®, and after "TEFLON®" insert about 0.5% to about 5% silicon, and the remainder a glass compound such as fiberglass. More preferably, the arrow rest launch of the preferred embodiment comprises a range of about 15% to about 25% LEXAN®, about 15% to about 25% TEFLON®, about 1% to about 3% silicon, and the remainder a glass compound such as fiberglass. Most preferably, the arrow launch composition comprises about 20% LEXAN®, about 20% TEFLON®, about 2% silicon, and the remainder a glass compound such as fiberglass.

Figure 1:
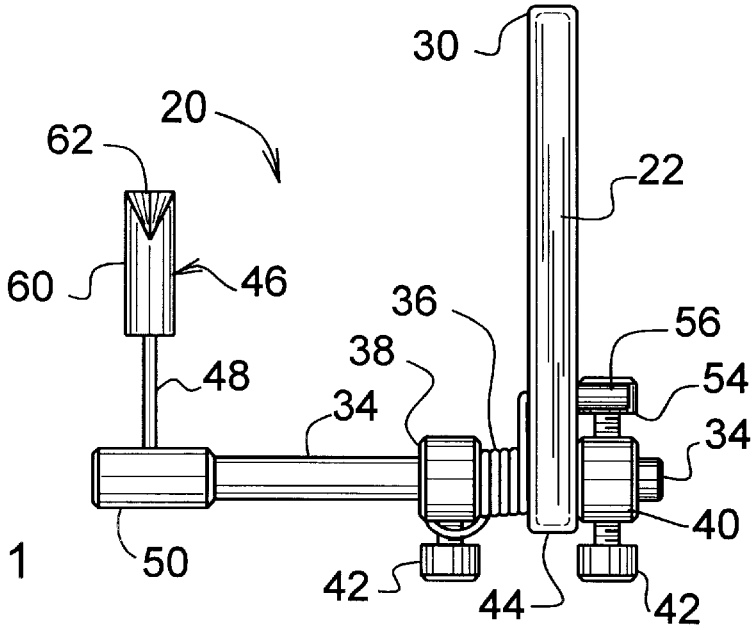
FIG. 1 is a schematic top plan view of a first preferred embodiment of the improved archery arrow rest launcher of the present invention.
Figure 2:
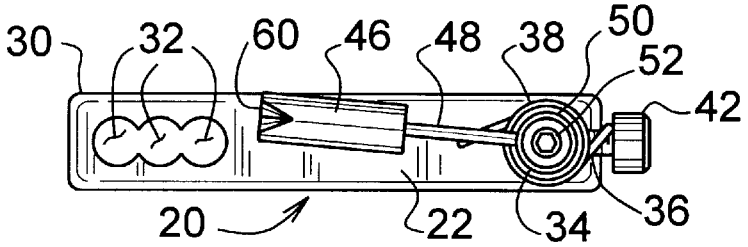
FIG. 2 is a schematic left side elevational view showing the rest of FIG. 1.
Figure 3:
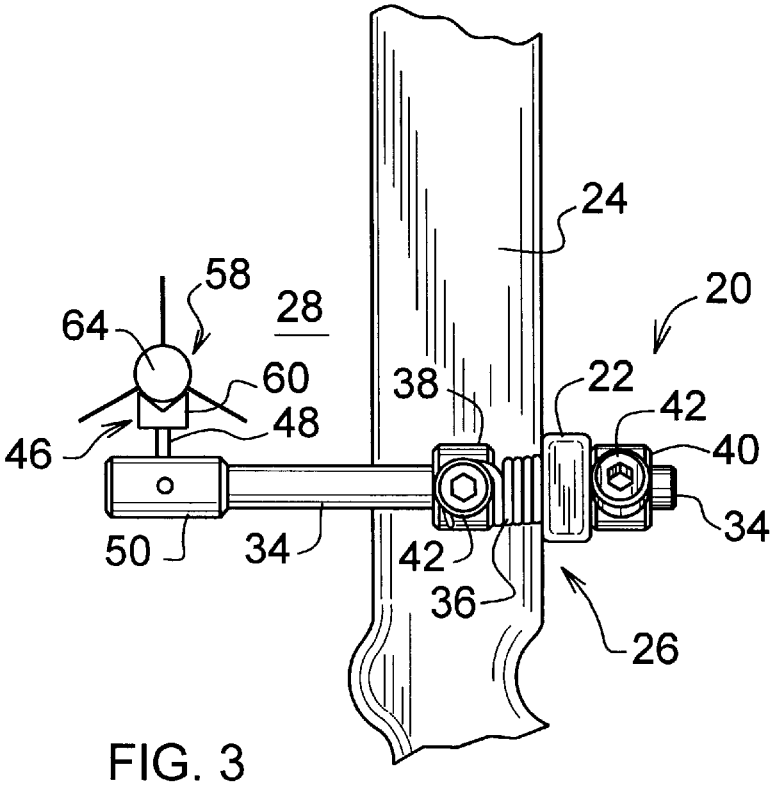
FIG. 3 is a schematic rear elevation of the rest of FIG. 1, showing the arrow rest and launcher mounted on an archer bow with an arrow shown in place resting on the launcher.

In reference to FIGS. 1–3, a conventional arrow rest is shown together with a first preferred embodiment of the arrow rest launcher of the present invention. Arrow rest 20 is shown which includes a generally horizontal elongated block 22 adapted for releasably mounting arrow rest 20 on the vertical sidewall 24 of an archery bow 26 opposite the arrow window 28 thereof. The front portion 30 of block 22 may have a plurality of overlapping transverse holes 32 therethrough, so that a transverse screw or bolt (not shown) can pass therethrough also through sidewall 24 to secure rest 20 in place. It is contemplated that any other suitable means for anchoring rest 20 to bow 26 can be used in place of block 22.

Arrow rest 20 also includes a transverse crossbar 34 pivotally secured as by a spring 36 and collars 38 and 40 with threaded locking nuts 42, to the rear end 44 of block 22. One end of spring 36 is wrapped around nut 42 on collar 38, the body of spring 36 is wrapped around crossbar 34 and the opposite end of spring 36 is releasably inserted into end 44 of block 22. Crossbar 34 extends behind bow 26 to a point behind arrow window 28 and is adjustable transversely, passing through block 22 and adjustably held by collars 38 and 40 to accommodate bows of various configurations.

A arrow rest launcher 46 such as shown in FIGS. 6–9 is formed by inserting a pin 48 into the bottom end of an elongated polymer composite block 60. The pin 48 is releasably secured to the free end 50 of crossbar 34, as by a threaded screw 52 intersecting pin 48 in end 50. The launcher 46 extends upwardly and forwardly into arrow window 28. Collar 40 has a front nut 54 which intercepts a pin 56 extending laterally from block 22 to limit upward rotation of launcher 46 by spring 36 while permitting downward rotation of launcher 46 against spring 36 by the depressing force of arrow 58 when shot from bow 26.

The front distal end (or top) of launcher 46 has at least one and preferably a plurality of notches 62 forming arrow receiving support guides, which slopes downward and increases in depth from the upper rear end to the lower front end thereof. Notch 62 cradles shaft 64 of arrow 58 to prevent it from shifting position and rolling off of polymer composite block 60 before shooting of arrow 58 from bow 26.

Accordingly, arrow launcher 46 is suitable for use with abrasive carbon arrows and the like. The pin 48 may have a threaded distal end for cooperate engagement with threads formed in a threaded bore drilled perpendicular to the longitudinal axis of crossbar 34, the pin may be held into position with a set screw which screws into the end 50 to bias the pin against the bore wall formed normal to the crossbar 34, or a set screw may be inserted into a threaded bore intersecting a bore drilled normal to the longitudinal axis of crossbar 34 and adapted for holding pin 48. Preferably, a holding means such as a set screw holds the smooth pin 48 in the desired position within a bore drilled into crossbar 34 normal to the longitudinal axis to allow for adjustment of the length (height) of the launcher 46 and rotation of the launcher pin 48 within the crossbar for rapid change or selection of a particular notch support guide 62.

Figure 4:
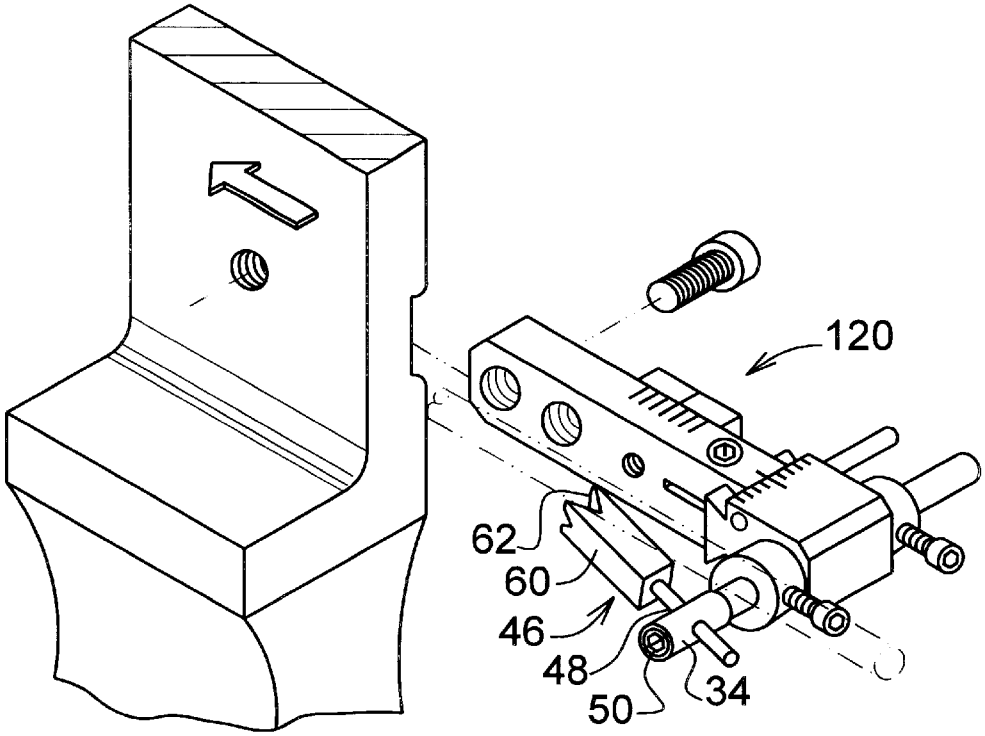
FIG. 4 is a sectional perspective view, from the left side of the arrow rest of the invention connected with an archer's bow showing the use of an alternate embodiment of an arrow rest having a single launcher.

FIG. 4 shows another embodiment of an arrow rest 120 such as is described in U.S. Pat. No. 5,372,119 and incorporated by reference heretofore, which utilizes the single launcher 46 of the present invention.

Figure 5:
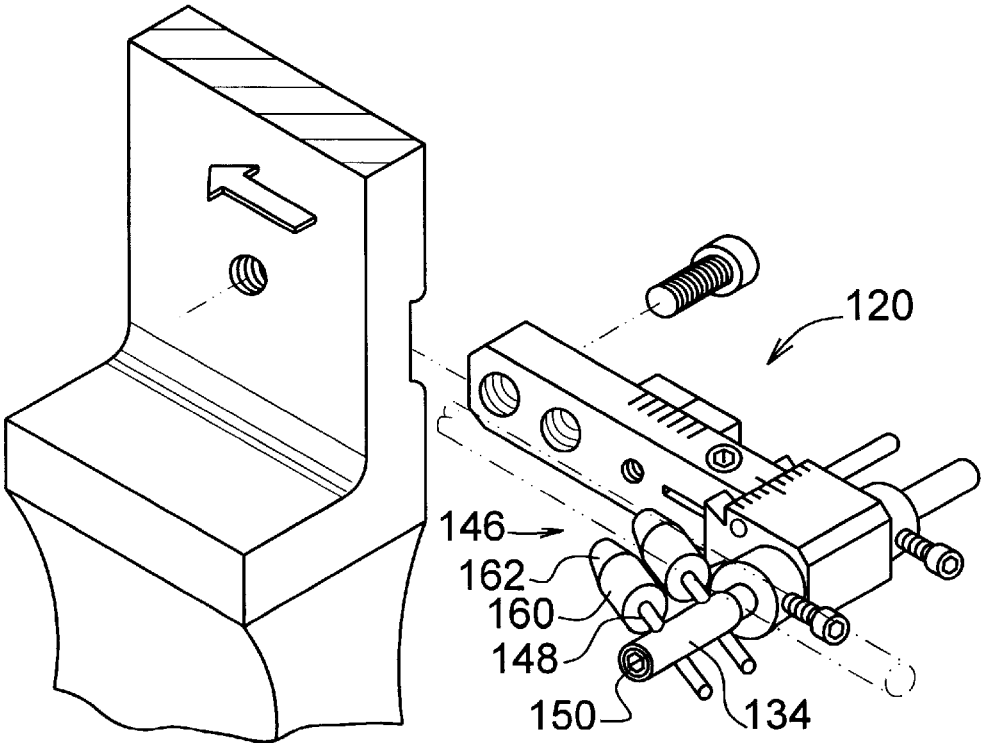
FIG. 5 is a sectional perspective view, from the left side of the arrow rest of the invention connected with an archer's bow of FIG. 4, showing the use of an alternate embodiment of an arrow rest having a double set of launchers.
Figure 6:
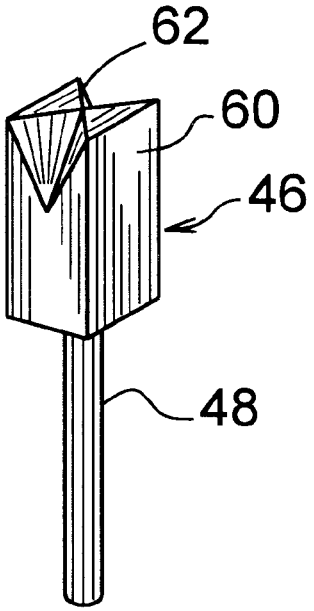
FIG. 6 is a perspective view of one preferred embodiment of a launcher having opposing arrow support guide notches for use with an arrow rest.
Figure 7:
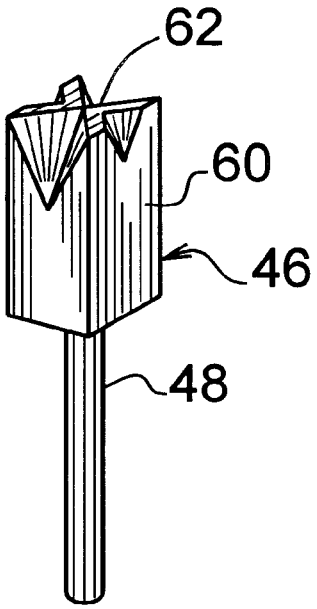
FIG. 7 is a perspective view of another preferred embodiment of a launcher having opposing arrow support guide notches of various sizes on each side of the launcher for use with an arrow rest.
Figure 8:
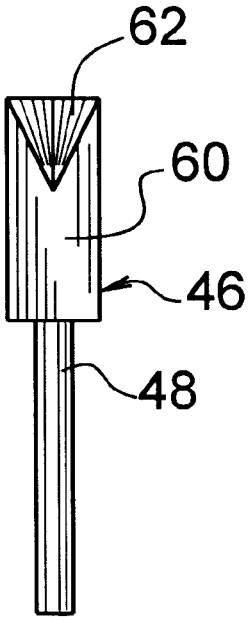
FIG. 8 is a side view of FIG. 7, showing a launcher having a support guide notch of a selected size.
Figure 9:
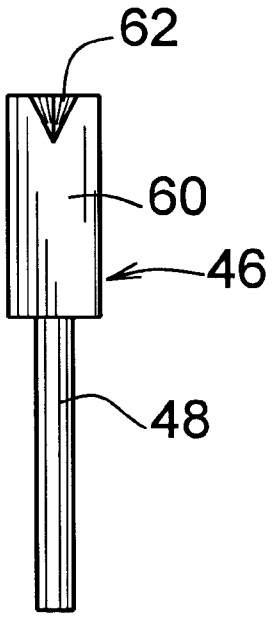
FIG. 9 is a side view of FIG. 7, showing a launcher having a support guide notch of different selected size.

FIG. 5 shows the arrow rest 120 embodiment of FIG. 4, utilizes a double barrel launcher 146 utilizing a pair of cylindrical polymer composite blocks 160 having tapered ends 162 supported by pins 148 and spaced apart from one another a selected distance and held by a crossbar 134. The pins 148 may have a threaded distal end for cooperate engagement with threads formed in a threaded bore drilled perpendicular to the longitudinal axis of crossbar 134, the pin 148 may be held into position with a set screw which screws into the end 150 to bias the pin against the bore wall formed normal to the crossbar 134, or a set screw may be inserted into a threaded bore intersecting a bore drilled normal to the longitudinal axis of crossbar 134 and adapted for holding pin 148.

Preferably, a holding means such as a set screw holds the smooth pins 148 in the desired position within a bore drilled into crossbar 134 normal to the longitudinal axis to allow for adjustment of the length (height) of the double barrel launcher 146 and rotation of the launcher pin 148 within the crossbar for rapid change of a double barrel launcher 146 and to permit spinning of the double barrel launchers 146 due to the forward movement of the arrow.

Figure 10:
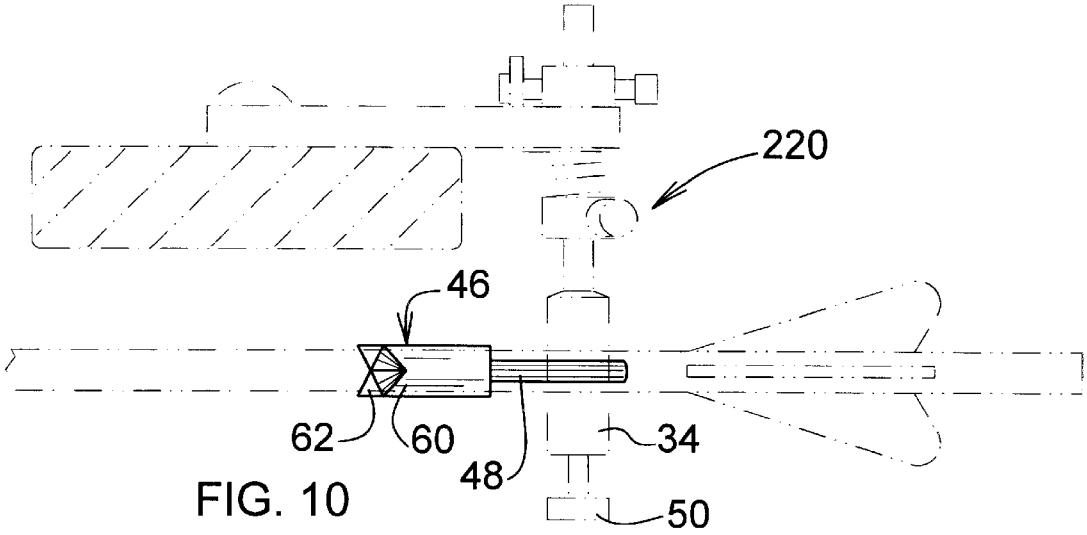
FIG. 10 is a top plan view of an arrow launcher showing the arrow rest in phantom lines and an arrow shown in phantom lines positioned within the support guide notch of a single launcher.
Figure 11:
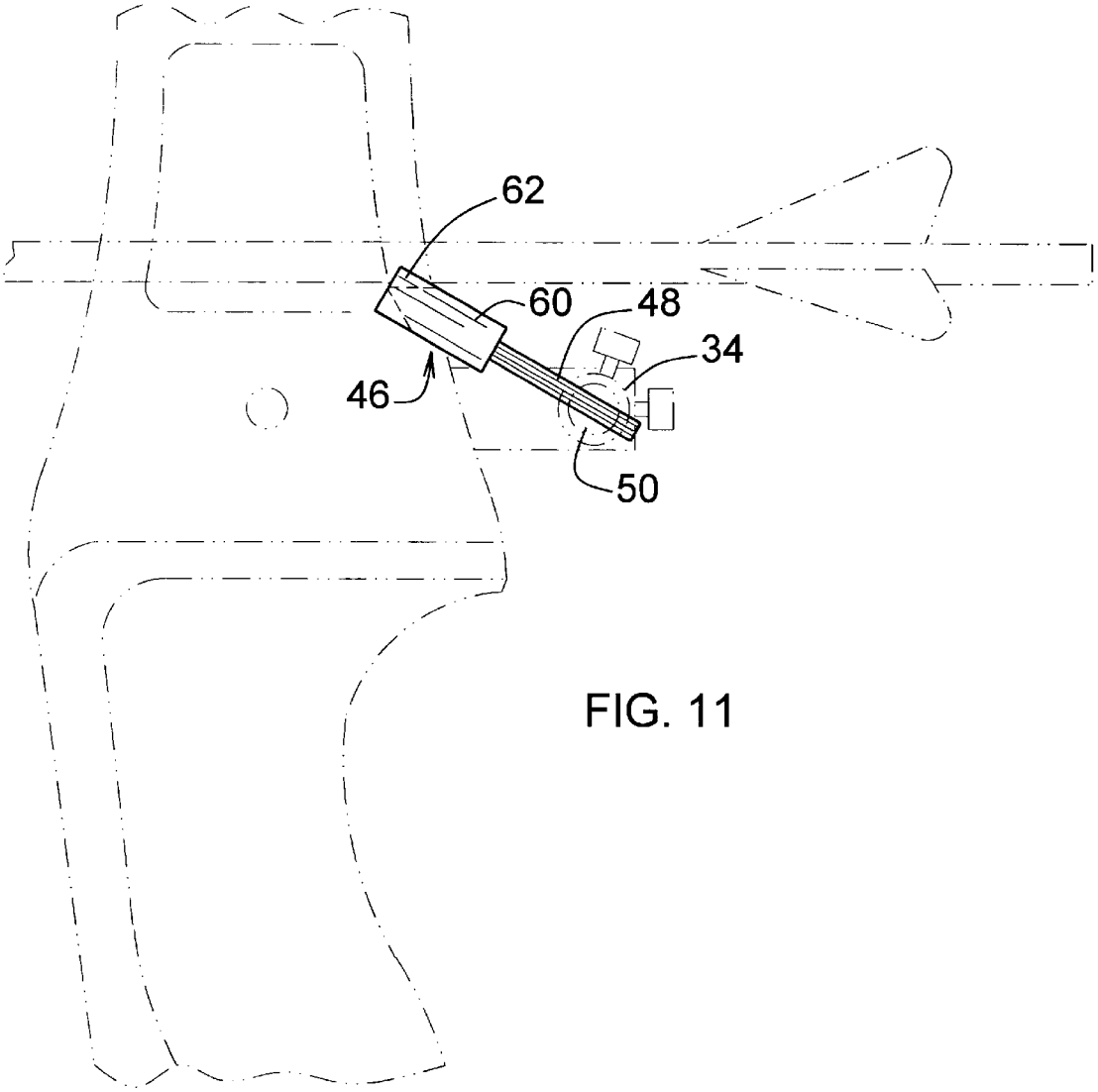
FIG. 11 is a side view of FIG. 10, showing an arrow launcher with the arrow rest in phantom lines and arrow shown in phantom lines positioned within the support guide notch of a single launcher.
Figure 12:
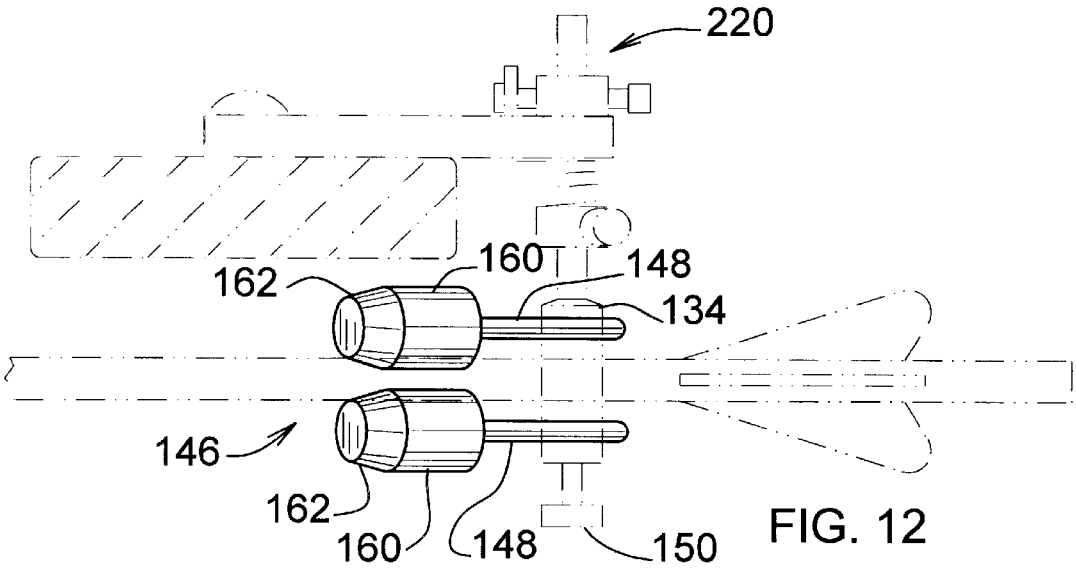
FIG. 12 is a top plan view of an arrow launcher showing the arrow rest in phantom lines and an arrow shown in phantom lines positioned within the support guide notch of a double barrel launcher.
Figure 13:
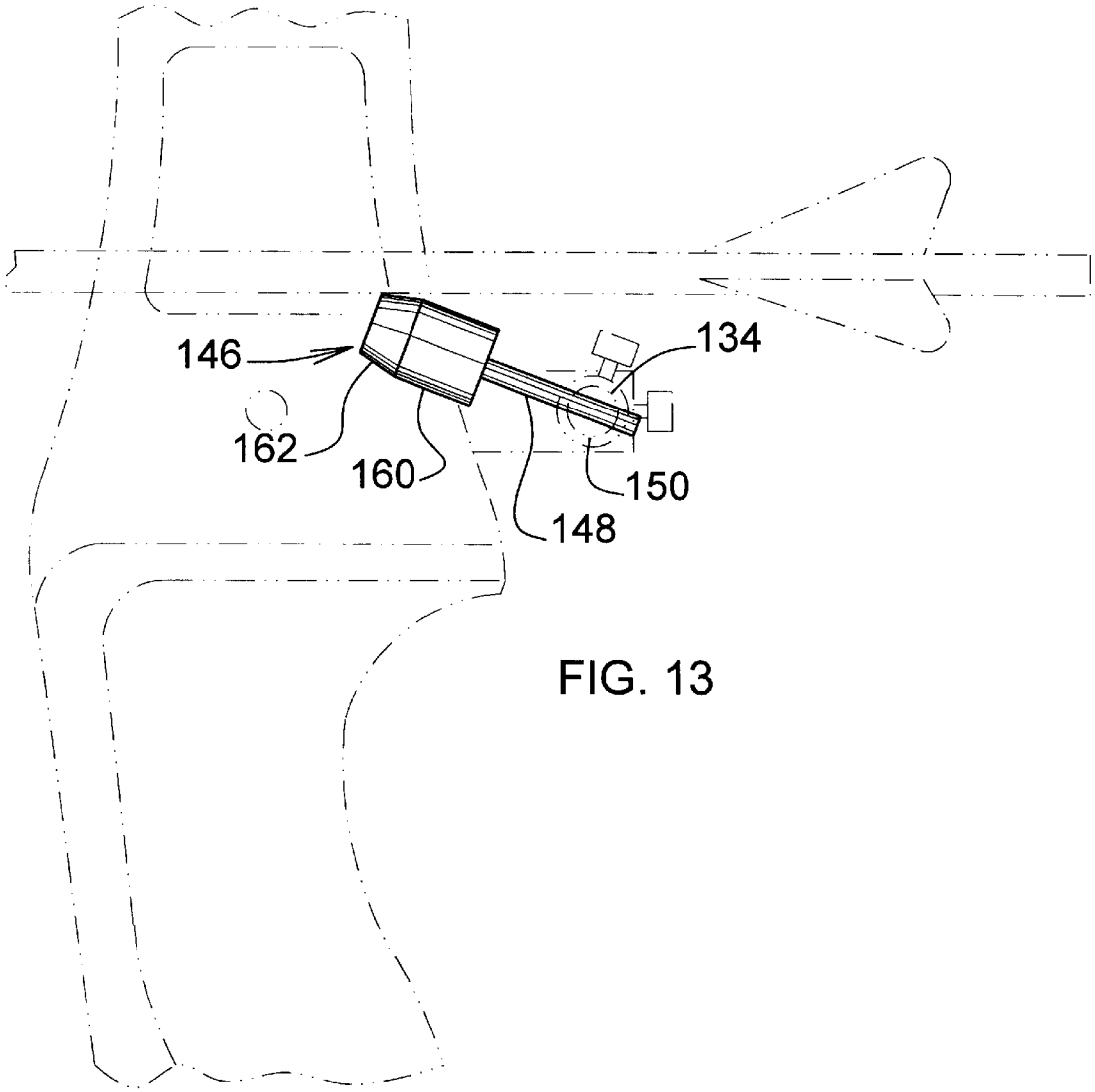
FIG. 13 is a side view of FIG. 12, showing an arrow launcher with the arrow rest in phantom lines and arrow shown in phantom lines positioned within the support guide notch of the double barrel launcher.
Figure 14:
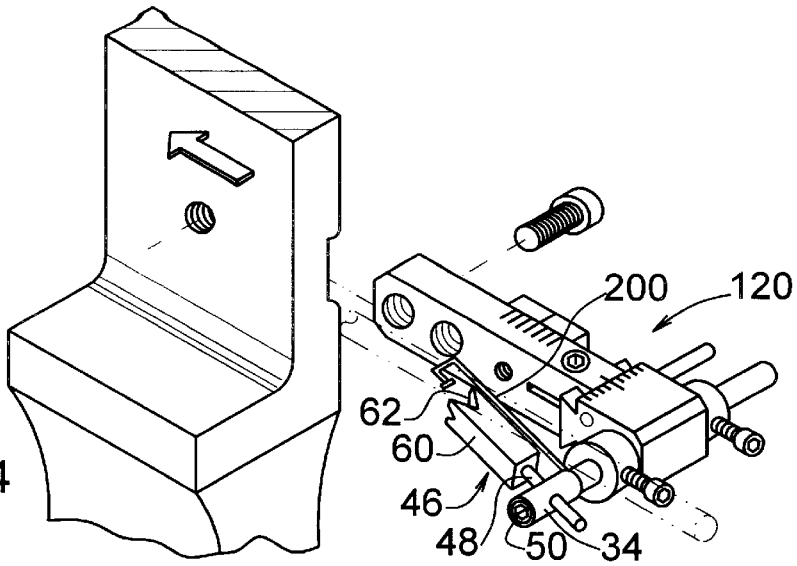
FIG. 14 is a sectional perspective view, from the left side of the arrow rest of the invention connected with an archer's bow showing the use of an alternate embodiment of an arrow rest having a single launcher in combination with a arrow holding means.
Figure 15:
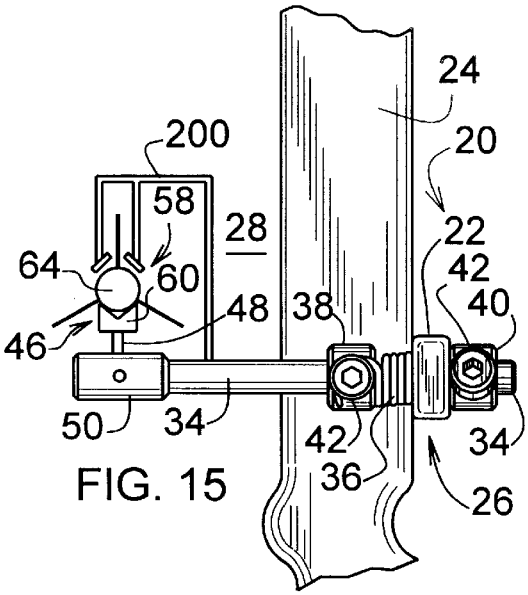
FIG. 15 is a schematic rear elevation of the rest of FIG. 1, showing an arrow rest and launcher mounted on an archer bow with an arrow shown in place resting on the launcher and retained by an arrow holding means.
Figure 16:
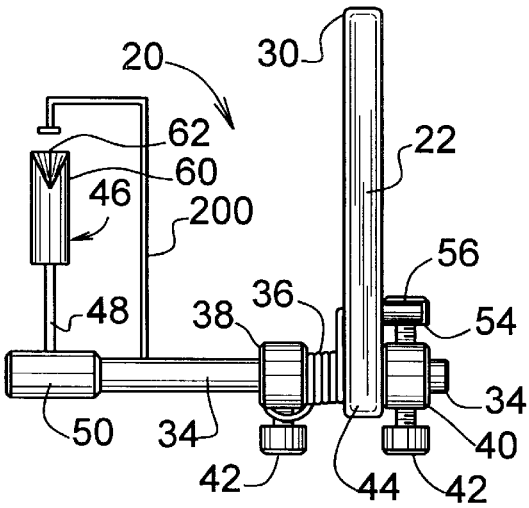
FIG. 16 is a schematic top plan view of an embodiment of the improved archery arrow rest launcher of the present invention.
Figure 17:
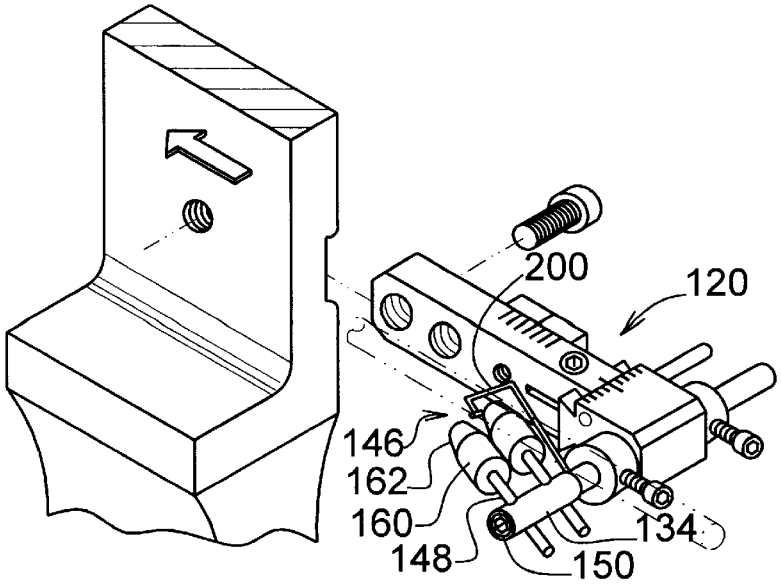
FIG. 17 is a sectional perspective view, from the left side of the arrow rest of the invention connected with an archer's bow showing the use of an alternate embodiment of an arrow rest having a double barrel launcher in combination with a arrow holding means.

FIGS. 10–11 show another embodiment of an arrow rest 220 which utilizes the single launcher 46 of the present invention. FIGS. 12–13 show another embodiment of an arrow rest 220 which utilizes the single launcher 46 of the present invention. FIGS. 14–17 show various embodiments of arrow rests utilizing the single launch 46 and double barrel launch 146 of the present invention in combination with an arrow retaining means 200.

Figure 18:
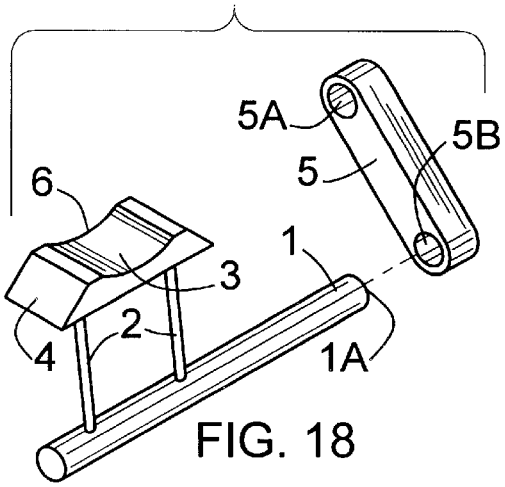
FIG. 18 illustrates an example of one arrangement within the scope of the present invention.

FIG. 18 illustrates one example of an arrow rest within the scope of the present invention where a rod 1 is provided having an end 1A adapted to be received in an aperture 5A of a holder 5 which is attached to a bow (not shown) by means of an aperture 5B as is known in the art. As shown in FIG. 18, 19 a rest block 3 is attached to rod 1 to be located in spaced relation from the rod. In the example shown in FIGS. 18 and 19, block 3 is connected to rod 1 by pins two 2 which are seated in rod 1 at one end and in the block 3 at the other end. In this manner block 3 is spaced above the rod and provides room for travel of the arrow 7 as described hereinafter.

Figure 19:
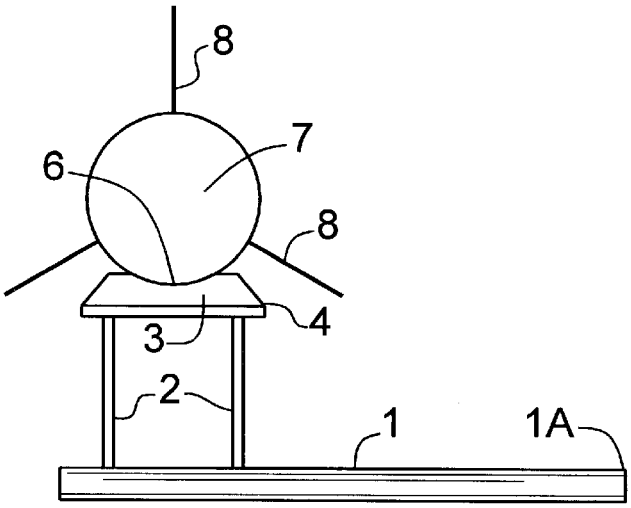
FIG. 19 illustrates an example of one arrangement within the scope of the present invention.

In accordance with one feature of the example of the present invention shown in FIGS. 18 and 19, block 3 and the other blocks shown in the other Figures is fabricated of a material which has low frictional coefficients in order to reduce the drag suffered by the arrow during launch and to improve the accuracy of the release of the arrow from the bow. TEFLON® and TEFLON® composites such as teflon-graphite composites have been found to be satisfactory.

In accordance with another feature of the example of the present invention shown in FIGS. 18 and 19, a groove 6 is provided in the rest block 3 to receive the shaft of an arrow 7 (FIG. 19) to guide the arrow out of the block. Additionally, in accordance with another feature of the example of the present invention shown in FIGS. 18 and 19, the sides 4 of the block 3 are tapered so the vanes 8 of arrow 7 can be aligned when the arrow is poised for launch so the vanes do not contact the block to divert the path of the arrow.

Figure 20:
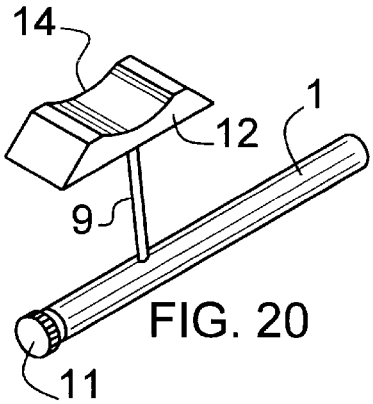
FIG. 20 illustrates an example of an arrangement within the scope of the present invention where the rest block is held on a single post.
Figure 21:
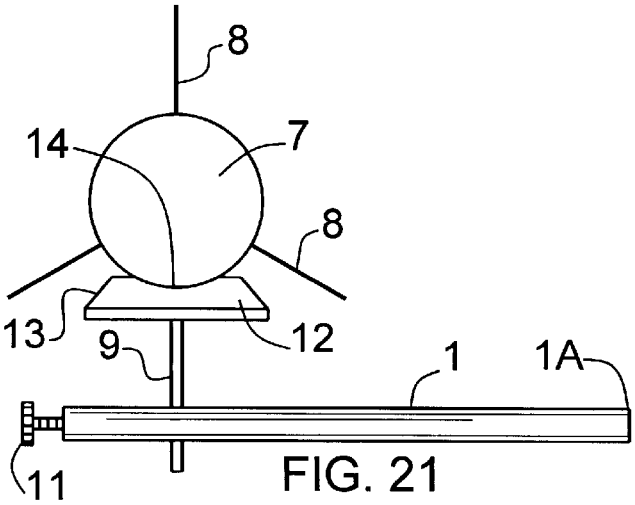
FIG. 21 illustrates an example of an arrangement within the scope of the present invention where the rest block is held on a single post.

In FIGS. 20 and 21, a rest block 12 is attached to rod 1 to again be located in spaced relation from the rod. In the example shown in FIGS. 20 and 21, block 12 is connected to rod 1 by a single pin 9 which can be seated in rod 1 at one end or can be received in an aperture in rod 1 and secured by a bolt 11 so that the distance of the block from the rod can be adjusted. As described with reference to FIGS. 18 and 19, the opposite end of the rod 1 is received in a mounting device such as holder 5 of FIG. 18. In this manner block 3 is adjustably spaced above the rod and the distance of the block from the holder 5 can be adjusted to provide room for travel of the arrow 7 as described hereinafter.

Again in accordance with another feature of the example of the present invention as described in FIGS. 18 and 19, a groove 14 is provided in the rest block 12 to receive the shaft of an arrow 7 (FIG. 21) to guide the arrow out of the block. As also described previously in accordance with another feature of the example of the present invention shown in FIGS. 20 and 21, the sides 13 of the block 12 are tapered so the vanes 8 of arrow 7 can be aligned when the arrow is poised for launch so the vanes do not contact the block to divert the path of the arrow.

Figure 22:
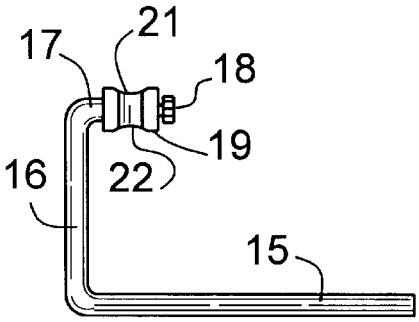
FIG. 22 illustrates an example of an arrangement within the scope of the present invention for use where arrows of different size can be accommodated.
Figure 23:
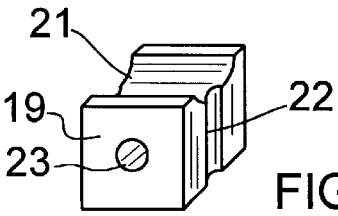
FIG. 23 illustrates an example of an arrangement within the scope of the present invention for use where arrows of different size can be accommodated.
Figure 27:
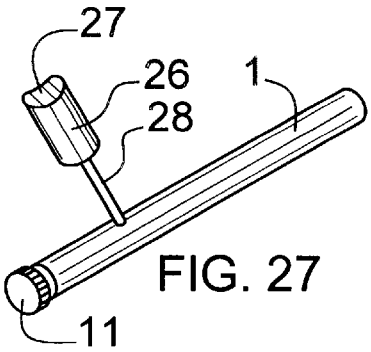
FIG. 27 illustrates an example of an arrangement within the scope of the present invention where the rest block is held on a single post.

FIGS. 22 and 23, present another arrangement within the scope of the present invention including a rest block 19 attached to an axis 17 and retained by a nut 18 to again be located in spaced relation from the rod. In the example shown in FIGS. 22 and 23, axis 17 is carried by an arm 16 which is in turn carried by a rod 15 equivalent to rod 1 of the previous Figures to be received in an aperture of a holder as previously described and secured to the bow (not shown) so that the distance of the block from the bow can be adjusted. In this manner the distance of the block from the holder 5 can be adjusted to provide room for travel of the arrow 7 as described hereinafter.

Again in accordance with another feature of the example of the present invention as described in FIGS. 18 and 19 block 19 is provided with at least two grooves 21, 22 allow the block to be rotated to different positions to receive the arrow shafts of different diameter. In practice, different diameter arrows are used for different purposes and devices of the type shown in FIGS. 22 and 23, allow the arrow size to be changed without changing the arrow rest as required by some prior art devices.

As also discussed previously in accordance with another feature of the example of the present invention shown in FIGS. 22 and 23 the width of the block 19 and the axis 17 can be selected so the vanes 8 of arrow 7 can be aligned when the arrow is poised for launch so the vanes do not contact the block to divert the path of the arrow.

Figure 28:
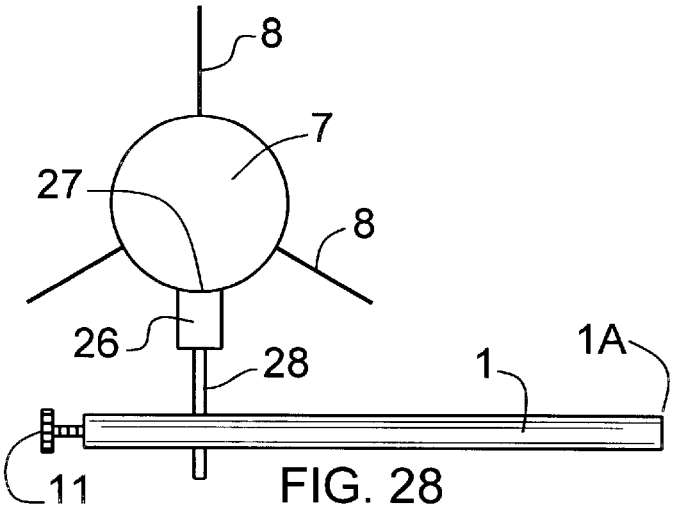
FIG. 28 illustrates an example of an arrangement within the scope of the present invention where the rest block is held on a single post.

FIG. 28 illustrates yet another arrangement within the scope of the present invention where an elongate rest block is provided having a body 26 of a material of low frictional coefficient yet sufficient rigidity to reliably support an arrow. Such materials include TEFLON® composites. A pin 28 extends out of the bottom of the body for attachment to a rod such as rod 1 of the examples of FIGS. 18–21.

Figure 26:
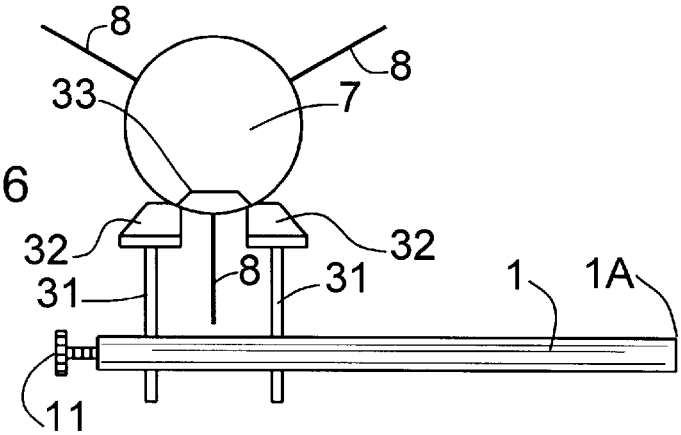
FIG. 26 illustrates another example of an arrangement within the scope of the present invention utilizing a post type rest.

In FIG. 26 a pair of rest blocks 32 are attached to rod 1 in spaced relation by pins 31. In the example shown in FIG. 26 blocks 32 have tapered inner surfaces 33 to define an opening therebetween to receive the arrow shaft. As described with reference to FIGS. 18 and 19 the opposite end of the rod 1 is received in a mounting device such as holder 5 of FIG. 18. In this manner blocks 32 can be adjustably spaced above the rod and the distance of the block from the holder 5 can be adjusted to provide room for travel of the arrow 7 as described previously.

Also, the width between the outer edges of blocks 32 can be such that the vanes of the arrow pass without contact.

Figure 24:
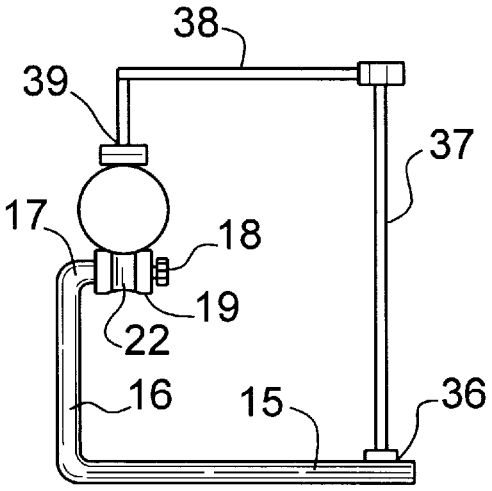
FIG. 24 illustrates an example of an arrangement within the scope of the present invention utilizing a post type rest.
Figure 25:
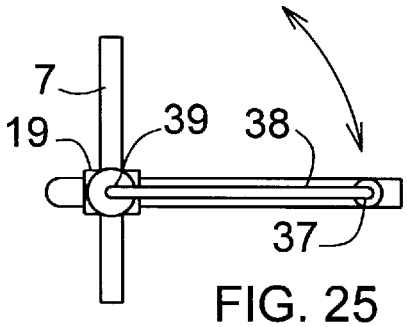
FIG. 25 illustrates an example of an arrangement within the scope of the present invention utilizing a post type rest.

FIGS. 24 and 25 illustrate another arrangement within the scope of the present invention illustrated with reference to the arrangement shown in FIG. 26 but it will be understood that the features could be used with the examples of any of the figures.

The arrangement shown in FIGS. 24 and 25 provide means for steadying the arrow prior to launch. In the arrangement shown, a post 36 is provided to extend upwardly from rod 1 and carries a swivel 37 which can be one way to allow an arm 38 to swing out of the way as the arrow leaves the rest. The arm can then be manually relocated when a new arrow is placed in the holders 32. Additionally a foot 39 can be provided to rest lightly on the arrow as shown.

It will be understood that the foregoing are but a few examples of arrangements within the scope of the present invention and that other arrangements also within the scope of the present invention will occur to those skilled in the art upon reading the disclosure.

The invention claimed is:

1. An arrow rest arrangement for an archery bow frame for use with an arrow having a shaft, comprising:

a base member attached to said bow frame including a first hole and means for securing said base member to said bow frame for rotating attachment thereto providing a means for height adjustment, said base member including a second hole for receiving a rod extending perpendicular from one side thereof in the horizontal plane and being rotatably adjustable therewith providing a means for angle adjustment;

a first pin received by said rod and extending outwardly from said rod and perpendicular thereto, said pin extending through said rod and being rotatably and slidably adjustable allowing for adjustment of the height and angle of said first pin;

at least one arrow rest block comprising a solid block of polymer comprising at least a portion of tetrafluoroethylene, said at least one arrow rest block having a recess therein for receiving a shaft of an arrow, and said at least one arrow rest block cooperatively engaging said first pin and extending upwardly therefrom, said at least one arrow rest block having a shape for cooperatively engaging and guiding an arrow thereover;

said first pin and said arrow rest block providing a means for adjusting the portion of said arrow rest block supporting said arrow.

2. The invention of claim 1, including a second pin received by said rod extending outwardly from said rod perpendicular thereto spaced apart from and in alignment with said first pin, said second pin extending through said rod and being rotatably and slidably adjustable allowing for adjustment of the height and angle thereof, said second pin including an arrow rest block having a recess therein for a shaft of an arrow and being spaced apart from, in alignment with, and opposing said at least one arrow rest block.

3. The arrow rest arrangement of claim 1, wherein said arrow rest block comprises a material selected from the group consisting of polycarbonate, polytetrafluoroethylene, a silicon compound, and a fiberglass compound.

4. The arrow rest arrangement of claim 3, wherein said arrow rest block comprises polycarbonate in an amount from about 10% to about 40%, polytetrafluoroethylene in an amount from about 5% to about 30%, and silicon in an amount from about 0.5% to about 5%, and the remainder being a fiberglass compound.

5. An arrow rest arrangement for an archery bow including:

a rod;

a base member attached to said bow and adapted to receive said rod;

a pin received by said rod extending outwardly from said rod;

an arrow rest block carried by said pin having at least one angled surface to support an arrow shaft prior to launching;

means for retaining an arrow shaft including a post extending outwardly from said rod;

a means for swiveling at the distal end of said post;

an arm received by said means for swiveling adapted to be moved from a first position for contacting said arrow shaft in said arrow rest to second position away from said arrow shaft.

6. The invention of claim 5, wherein said block includes at least one groove for receiving said arrow shaft.

7. The invention of claim 6, wherein said block is multi-sided and includes said groove in at least two sides for receiving said arrow shaft.

8. The invention of claim 7, wherein said at least two sides of said multi-sided block includes a groove of a different size.

9. An arrow rest arrangement for an archery bow including;

a rod;

a base member attached to said bow and adapted to receive said rod;

a bracket extending outwardly from said rod;

an axis extending parallel to said rod from the end of said bracket;

an arrow rest block having an aperture for receiving said axis, said arrow rest block having a groove for supporting an arrow shaft prior to launching.

10. The arrow rest arrangement of claim 9, said arrow rest block being rotatable around said axis.

11. An arrow rest block having at least one groove therein for receiving a shaft of an arrow, said block comprising a material selected from the group consisting of polycarbonate, polytetrafluoroethylene, a silicon compound, and a fiberglass compound.

12. The arrow rest block of claim 11, comprising polycarbonate in an amount from about 10% to about 40%, polytetrafluoreothylene in an amount from about 5% to about 30%, and silicon in an amount from about 0.5% to about 5%, and the remainder being a fiberglass compound.

13. An arrow rest block having a groove therein for guiding a shaft of an arrow, said block comprising a polytetrafluoroethylene material.

* * * * *